US007281486B2

(12) United States Patent
Bach et al.

(10) Patent No.: US 7,281,486 B2
(45) Date of Patent: Oct. 16, 2007

(54) MARINE WINDSHIELD AND COCKPIT COVER ATTACHMENT SYSTEM

(76) Inventors: Darren A. Bach, 7993 Progress Way, Delta, British Columbia (CA) V4G 1A3; Robin A. Cnudde, 7993 Progress Way, Delta, British Columbia (CA) V4G 1A3

( * ) Notice: Subject to any disclaimer, the term of this patent is extended or adjusted under 35 U.S.C. 154(b) by 0 days.

(21) Appl. No.: 11/374,531

(22) Filed: Mar. 14, 2006

(65) Prior Publication Data

US 2007/0215031 A1 Sep. 20, 2007

(51) Int. Cl.
*B63B 17/00* (2006.01)

(52) U.S. Cl. ..... 114/361

(58) Field of Classification Search ..... 114/343, 114/361; 156/108, 291; 296/96.21, 108
See application file for complete search history.

(56) References Cited

U.S. PATENT DOCUMENTS

| | | | | |
|---|---|---|---|---|
| 2,605,871 | A | 8/1952 | Kress et al. | |
| 2,639,751 | A | 5/1953 | Flaherty | |
| 3,304,657 | A | 2/1967 | Singleton | |
| 3,367,349 | A | 2/1968 | O'link | |
| 3,810,267 | A | 5/1974 | Fussell et al. | |
| 3,978,535 | A * | 9/1976 | Swan et al. | 114/361 |
| 4,815,410 | A * | 3/1989 | Muhlberger | 114/361 |
| 4,993,351 | A * | 2/1991 | Zirkelbach et al. | 114/361 |
| 5,189,980 | A * | 3/1993 | Zirkelbach et al. | 114/361 |
| 5,839,388 | A | 11/1998 | Vadney | |
| 6,453,841 | B1 | 9/2002 | Shearer et al. | |
| 6,800,160 | B2 | 10/2004 | Norman | |

FOREIGN PATENT DOCUMENTS

CA 685026 4/1964

OTHER PUBLICATIONS

Picture of a Century classic boat with snaps on lower frame (cover up).
Picture of a Century classic boat with cover snaps on lower frame.
Picture of a Century classic boat with cover and snaps on lower frame.
Picture of a Century classic boat with cover snapped on lower frame.
1967 Resorter 17 FGL from book entitled "Classic Century Powerboats" published 2002 by MBI Publishing Company.
Pacific Coast Marine Windshields Ltd. 1999 extrusion drawing.

* cited by examiner

*Primary Examiner*—Lars A. Olson

(57) ABSTRACT

A marine windshield and cockpit cover attachment system, utilizing a slot longitudinally extending along an elongated windshield frame, and where the windshield frame extends longitudinally around the edge of a windshield glass, where a series of plastic cover snap anchors are mounted within the slot. With the slot having inward facing lips, so that the anchors, having a pair of protruding tabs, are pressured onto the underside of the lips when a metal screw holding a plastic washer and a metal cover snap retainer, is inserted into the anchors so to clamp the anchors and cover snap retainers together on the slot lips, where the cover snap retainers are oriented in a forward and outward direction along the slot, and making no metal contact with the windshield frame. An alternate method included is a flexible anchor for attachment under a windshield lip of a hidden windshield lower frame.

15 Claims, 8 Drawing Sheets

10
12b
24
26
30
28
14
22
16
20
21
13a
13
12a
21a

13b 30
30b
30a
30c 30
30b
30a
30c 30
30a 30
30b
30a
30c 28
32a
32
32b
26
30
22

28
22
26
30

28
22
34
26
30

MARINE WINDSHIELD AND COCKPIT COVER ATTACHMENT SYSTEM

TECHNICAL FIELD

The invention relates to a marine windshield and cockpit cover attachment system, and more specifically to a marine windshield cover attachment system utilizing lineal adjustable snaps, which are securely clamped along a groove or slot in either of the top and or the bottom of a windshield frame. The system includes an attachable and separable edge anchoring method, for attachment of a windshield and cockpit cover under a windshield bottom edge of a hidden windshield mounted lower frame.

BACKGROUND OF THE INVENTION

A canvas type covering of a marine windshield and cockpit area is generally attached when the boat is not in use, either during storage or transportation, so as to protect the cockpit and commonly the windshield. A standardly accepted approach currently in use to attach a canvas or cover, employs a series of expanding fastener for fastening metal snaps within a groove along either the top and or the bottom of an extruded frame. One such method is described in U.S. Pat. No. 5,839,388 issued to Vadney on Nov. 24, 1998, entitled, Clip Assembly; also as described in U.S. Pat. No. 6,453,841 issued to Shearer, et al. on Sep. 24, 2002, entitled, Windshield Bottom Trim.

For many years it has been common to mount a boat cover to either the top frame, or the bottom frame of a boat windshield utilizing different types of fasteners for different types of boat covers. Inventor is aware of the following patents; U.S. Pat. No. 2,639,751 issued to Flaherty on May 26, 1953, entitled, Cover for Vehicles. And a Canadian Patent 685,026 issued to Dagenis, on Apr. 21, 1964, entitled, Windshield Rim Molding. The Canadian 062 patent shows a metal extrusion with a track or groove used for holding anchors and snaps, where the fastener anchor is adjustable along the groove and fixably tightened against elongated lips within the outer edges on the insides of the groove, by tightening a screw, where the screw holds a snap fastener.

One predominant example of boat cover windshield attachment from the later 1960's era and later is the Century Boats Company. Century used both types of covers, those that covered both the windshield and cockpit area and those that covered the cockpit area only, usually this type was from the top of the windshield. There are various publications which show top and bottom windshield frame covers and snaps from this era, such as the advertisement for a 1967 Century Resorter, shown on the copy provided (the disclosure of which is hereby incorporated by reference herein). Other classic Century boat photos from this era are included, showing the covers in place.

As mentioned, some designs used an array of snaps on the top or the bottom of the outside of a windshield, as well an array of snaps on the inside bottom of the windshield was used. An example of this is an aluminum extrusion design dated March 1999, as was used by Pacific Coast Marine Windshields Inc (the disclosure of which is hereby incorporated by reference herein). This extrusion is shown as FIG. 9 marked as Prior Art.

U.S. Pat. No. 3,810,267 issued to Fussell et al. on May 14, 1974, entitled Boat Windshield Mounting Means, shows a windshield frame with a lineal groove on the lower outside of the front windshield. Although this patent does not disclose the use of snaps mounted on the bottom of the frame, the lineal groove in the lower windshield frame was readily adapted to mount such cover snaps as is shown herein as FIG. 8 below marked as Prior Art. The most common type of snap fasteners used for this type of windshield frame in the era, are shown in FIG. 4 and FIG. 3 within U.S. Pat. No. 3,304,657 issued to Singleton on Feb. 21, 1967, entitled, Skiff Windshield for Boats, (filed on Sep. 29, 1964) or similarly as shown in U.S. Pat. No. 3,367,349 issued to O'link on Feb. 6, 1968, entitled, Boat Canopy Holding Means.

Also of interest, is U.S. Pat. No. 6,800,160 issued to Norman on Oct. 5, 2004, entitled Stress Free Mounting System for Sheet Material.

Inventor is also aware of U.S. Pat. No. 2,605,871, issued to Kress et al. On Aug. 15, 1952, entitled Fastening Device. This fastener is designed as an automotive molding attachment means, which uses a fixed fastener within a panel to attach a moulding having a track or slot, so as to be able to adjust the molding on the body panel.

Problems that arise with the expandable type of fastener as described in the Vadney U.S. Pat. No. 5,839,388 patent and again in the Shearer U.S. Pat. No. 6,453,841 patent, are that, over time or when heated by the sun or wet, the fastener becomes loose and can be easily misplaced along the groove, making cover attachment difficult. Also, this expandable type fastener cannot be retightened. Norman describes a solution to this problem in U.S. Pat. No. 6,800,160, where the screw threads are meant to cut through the plastic fastener into the aluminum extrusion on both the top and bottom windshield frame rails, but this may be subject to corrosion by galvanic action between the screw and the aluminum.

The fastener as described in Canadian patent 685,026, does not have the previously mentioned problem of galvanic action, with the plastic fastener within the channel alone contacting the frame rail, but the plastic fastener cannot be easily removed for replacement, if for instance the threads were stripped out of the fastener within the groove. The older established style snap clip, as is shown in Singleton U.S. Pat. No. 3,304,657 patent, cannot be fixed tightly and the metal-to-metal contact is prone to galvanic corrosion.

In another aspect of the current invention as described below, is adapted for attachment of a cover to the bottom edge of the windshield, which is suited for use to the invention as disclosed in U.S. patent application Ser. No. 11/155,942 is specifically adapted for a windshield with a hidden mounting frame. Applicant is aware that several flexible catch systems that have been used, such as is shown in U.S. Pat. No. 3,122,394 issued to Brydon on Feb. 25, 1964, entitled Convertible To Interlock. Also as shown in U.S. Pat. No. 3,172,419 issued to Lewis on Mar. 9, 1965, entitled Canopy Lock for Boats. As well as U.S. Pat. No. 5,215,032 issued to Ellis, et al. on Jun. 1, 1993, entitled, Apparatus and Method for Rapidly Attaching a Boat Cover or Canopy to a Windshield.

Accordingly it is an object of the present invention to provided a cover attachment fastener that can be tightened and if necessary retightened, without metal-to-metal contact.

Another object of the present invention is to provide a cover attachment fastener that can be easily replaced without the need for any disassembly of the windshield frame.

Yet another object of the present invention is to provide a cover attachment fastener that is a single unit for easier installation.

Still another object of the present invention is to provide a cover attachment fastener system for a windshield having a hidden lower mounting frame.

Further, it is an object of the present invention to provide a windshield and boat cover attachment system to suit existing manufactured covers.

Still a further object of the present invention is to provide a windshield cover attachment system that can be linearly adjustable, as may be required.

The marine windshield and boat cover attachment system of the present invention has other objects and features of advantage which will become apparent from and are set forth in more detail in, the accompanying drawings and following details.

DISCLOSURE OF THE INVENTION

The marine windshield and cockpit cover attachment system of the present invention is designed to fit onto the front of, either the top or the bottom of, a marine vessel windshield, and comprises briefly of an elongated windshield frame longitudinally extending around the edge of the windshield, and where the windshield frame has a top length and a bottom length, where the bottom length is mounted to a boat deck, and where the windshield frame has a forward and outward oriented slot longitudinally extending along the windshield frame, where the slot accepts a series of plastic cover snap anchors.

The forward oriented slots have inward facing lips on the slots outer edges, where each cover snap anchor attaches within the slot and may be adjusted linearly along the slot for matching to the boat cover's female snaps. These anchors have a central hole, where a screw holding a male cover snap retainer is threaded into, so the male retainer can be attached to the cover's female snap. The anchors are designed so that no metal-to-metal contact is made with the screw fastener and the windshield frame, while allowing the fastener to be tightened and retightened as required.

In the first embodiment of the present invention, the molded plastic anchor is wing-like, where the anchor wings or tabs, are inserted into the slot and rotated to extend under the slot lips. When the screw, holding the male snap retainer with a plastic washer thereunder as a unit, is tightened, the anchor is rotated and the screw clamps the tops of the tabs to the under edge of the slot lips and the washer to the outer edge of the slot, to fix the anchor and the snap retainer in a outward and forward orientation along said windshield frame and in the appropriate spot to coincide with the female snaps on the cover.

The anchor is caused to rotate, when the screw is turned to tighten, by the friction of the screw threads against the walls of the anchor's hole, thus causing the anchor tabs to come around and under the slot lips as the screw is tightened. The anchor may include one or more spring like extensions, where the extension when inserted into the slot spring out and cause the anchor to rotate into contact with the inner side of the slot, at which point when the screw, with washer and snap retainer is tightened together, the tabs come into contact under the slot lips. This spring like extension is designed so as to insure rotation of the anchor, such as may be needed if the threads on the anchor have been previously used and are loose.

As well the first embodiment of the present invention the snap retainer anchor includes an alternate spline on upper contact surface of tabs. Where the splines will fit into coinciding grooves under slot lips, so as to prevent counter rotation and ejection of anchor under extreme tension.

Further, the first and second embodiment of the present invention allows the anchor, the screw, the flat washer and male snap retainer to be sold and installed as a single unit.

In a second embodiment of the present invention the molded plastic anchors have a base with apposing vertical tabs, where the vertical anchor tabs, spring out into contact with the inner side of the slot after they are inserted into the slot and under the slot lips. When the screw holding the male snap retainer with plastic washer thereunder, is tightened, the screw pull the tabs up and the tabs clamp against the underside of the slot lips, with the washer clamping against the outer-edge of the slot, and so fixing the anchor with the snap retainer in a outward and forward orientation along the windshield frame. The anchor and fastener can be adjusted and tightened in any appropriate spot along the windshield frame to coincide with the female snaps on the boat cover.

In a third embodiment of the present invention a hidden windshield mounting system is installed on a boat deck, where the bottom windshield frame length is mountable to a boat deck rearward of the windshield. In this configuration, the windshield is positioned up a small distance, away from the boat deck, thereby forming a forward and outward oriented slot, longitudinally extending along the bottom of the windshield.

The slot below the windshield accepts a series of cover snap anchors, where these anchors are J-shaped to hook or attach under the bottom of the windshield glass. The anchors include on their upper section a male snap retainer for attachment to the female snaps of a common boat cover as above.

To attach these anchors, the anchors are pushed in under the bottom edge of the windshield glass unattached to the boat cover, or attached to the boat cover and then pushed under the bottom edge of the windshield glass.

These anchors may also include a second protruding tab, where the second tab is directed to the boat deck to assist in securing the anchors to the windshield bottom edge by their friction against the boat deck. The anchor second protruding tab has spring like qualities, wherein the second protruding tab holds the anchor against the windshield bottom. The second protruding tab may be made of two flexible materials molded into a single unitary member.

As well these anchors include a smooth surface under the male snap retainer to protect the lower front area of the windshield from being scratched, either when in use, or when being adjusted along the slot during attachment of the boat cover. Further, the anchors can be sewn onto the edge of a boat cover as opposed to using male and female snaps.

BRIEF DESCRIPTION OF THE DRAWINGS

Advantages of the present invention will become more fully appreciated as the same becomes better understood when considered in conjunction with the following detailed description of an illustrative embodiment and accompanying drawings, in which like reference characters designate the same or similar parts throughout the several views, wherein.

DETAILED DESCRIPTION OF THE PREFERRED EMBODIMENTS

Figure 1:
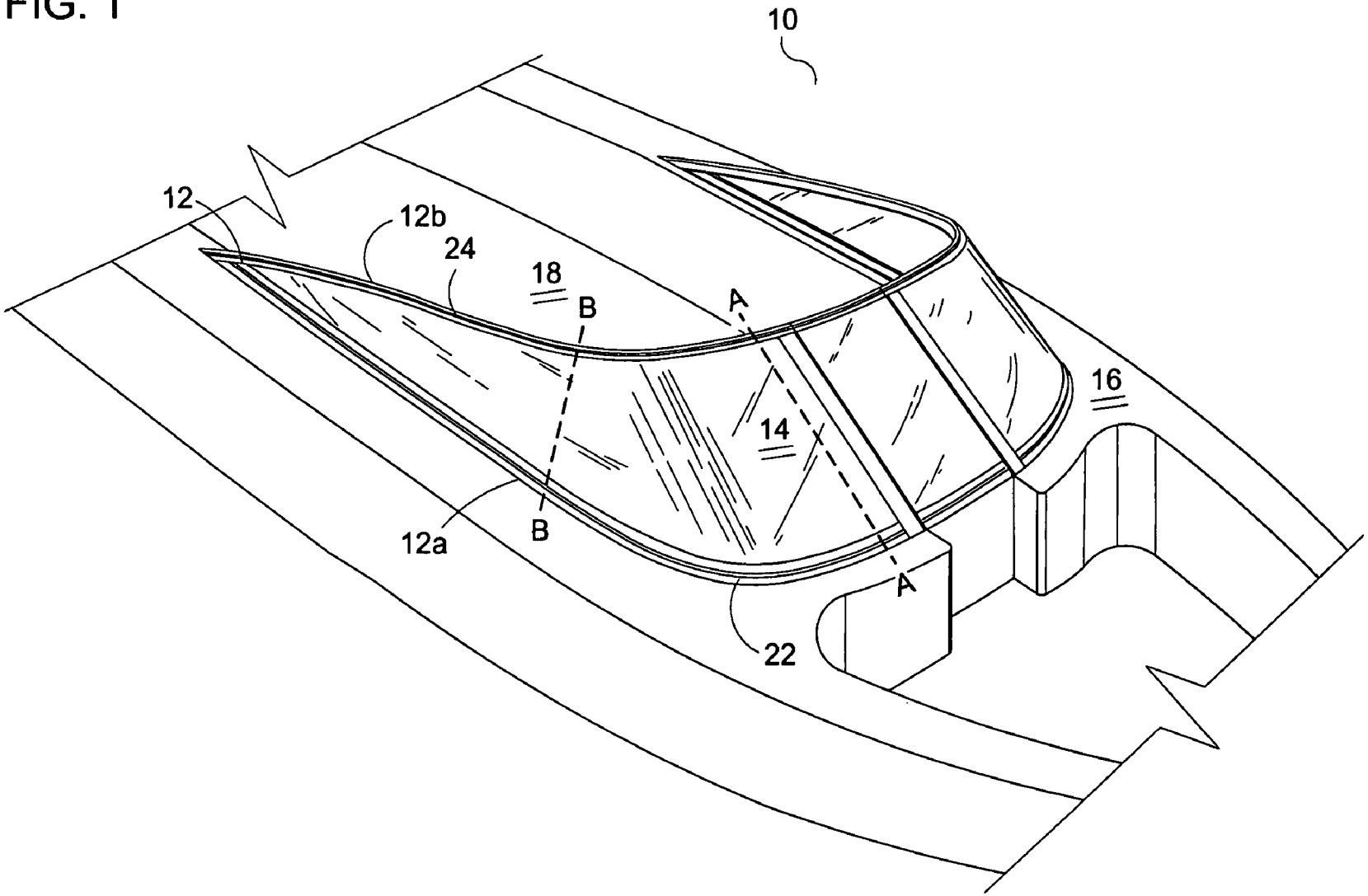
FIG. 1 is a partial perspective view of the invention showing the windshield frame mounted onto a boat deck.

The marine windshield and cockpit cover attachment system of the present invention is generally referred to as 10 as shown in a perspective view in FIG. 1. The cover attachment system 10 includes an elongated windshield frame 12, where windshield frame 12 consists of a bottom frame 12*a* and top frame 12*b* and where windshield bottom frame 12*a* and top frame 12*b* extend longitudinally around the edge of the windshield glass 14. Windshield bottom frame 12*a* is mounted onto a boat deck 16. Behind windshield 14 is a cockpit 18.

Figures 2A, 2B:
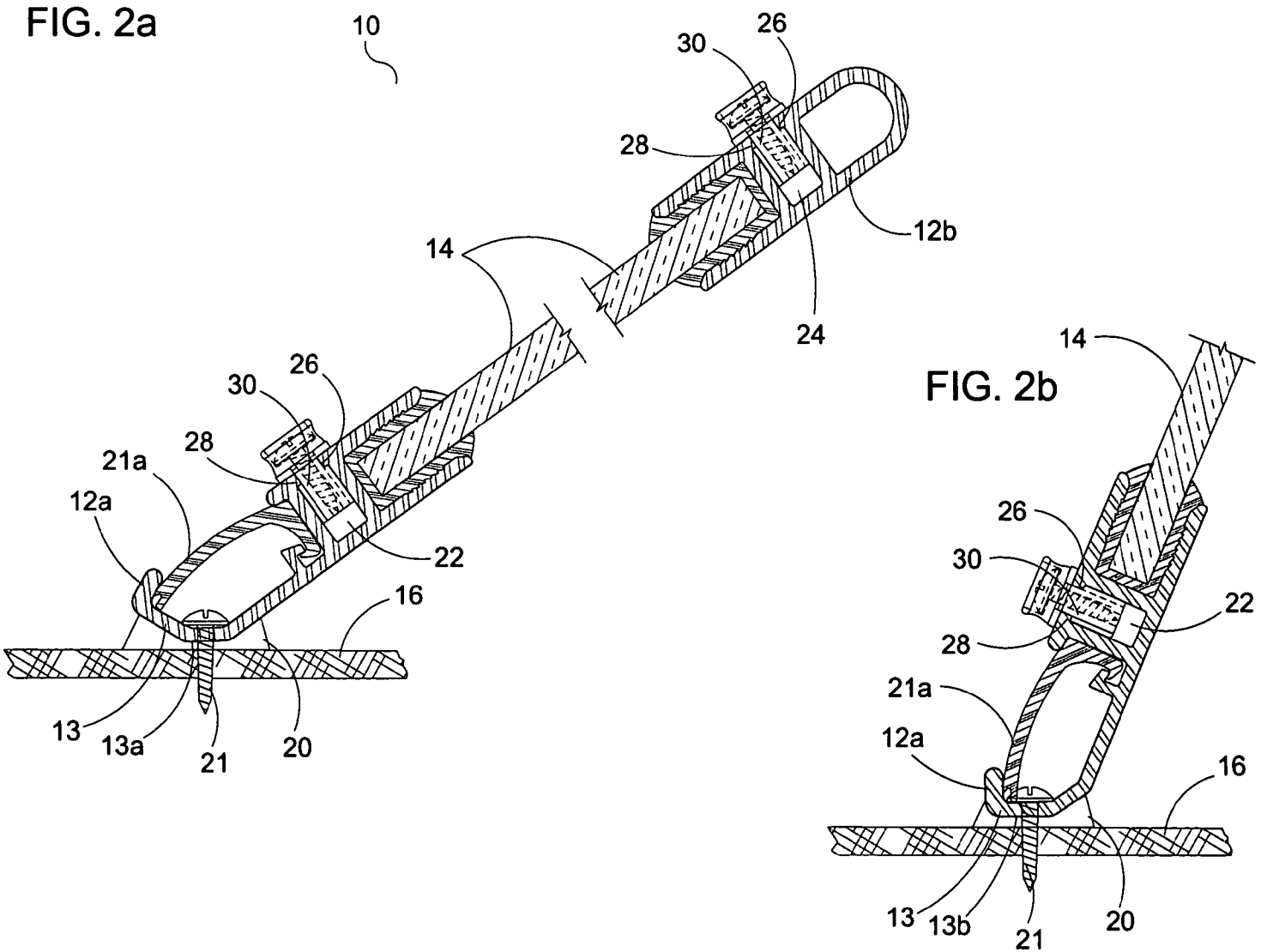
FIG. 2*a* is a partial sectional view of the invention taken along line A from FIG. 1, showing the lower windshield frame mounted onto a boat deck.
FIG. 2*b* is a partial sectional view of the invention taken along line B from FIG. 1, showing only the lower windshield frame and mounted onto a boat deck.

As best shown in partial sectional view FIG. 2*a*, bottom windshield frame 12*a* has a lower dual segmented chamfered surface 13 for mounting onto deck 16 with a windshield gasket 20, where gasket 20 creates a seal between the bottom frame 12*a* and boat deck 16. Bottom windshield frame 12*a*, which is mounted onto deck 16 using screws 21, where screws 21 are covered by a lineal flexible screw cover 21*a*, where lineal flexible screw cover 21*a* extends along the outer length of lower windshield frame 12*a*.

FIG. 2*a* shows how the bottom windshield frame 12*a* is rigidly supported by lower segmented chamfered surface 13*a* for mounting onto deck 16 and windshield gasket 20 in the forward windshield mounting area.

FIG. 2*b* shows how the bottom windshield frame 12*a* is rigidly supported by lower segmented chamfered surface 13*b* for mounting onto deck 16 and windshield gasket 20 in the rearward windshield mounting area.

Windshield bottom frame 12*a* and top frame 12*b* have forward and outward oriented slots 22 and 24 respectively, where slots 22 and 24 extend longitudinally along the windshield bottom frame 12*a* and top frame 12*b*. Slots 22 and 24 include inward facing lips 26 and 28 on the slots outer edges. Slots 22 and 24 accept a series of plastic cover snap anchors 30, where each cover snap anchor 30 is inserted within the slots 22 and 24 and anchors 30 are adjusted linearly along slots 22 and 24 for tightening onto lips 26 and 28, in a position to match the boat cover's female snaps (not shown).

Figures 3A, 3B, 3C, 3D, 3E, 3F, 3G:
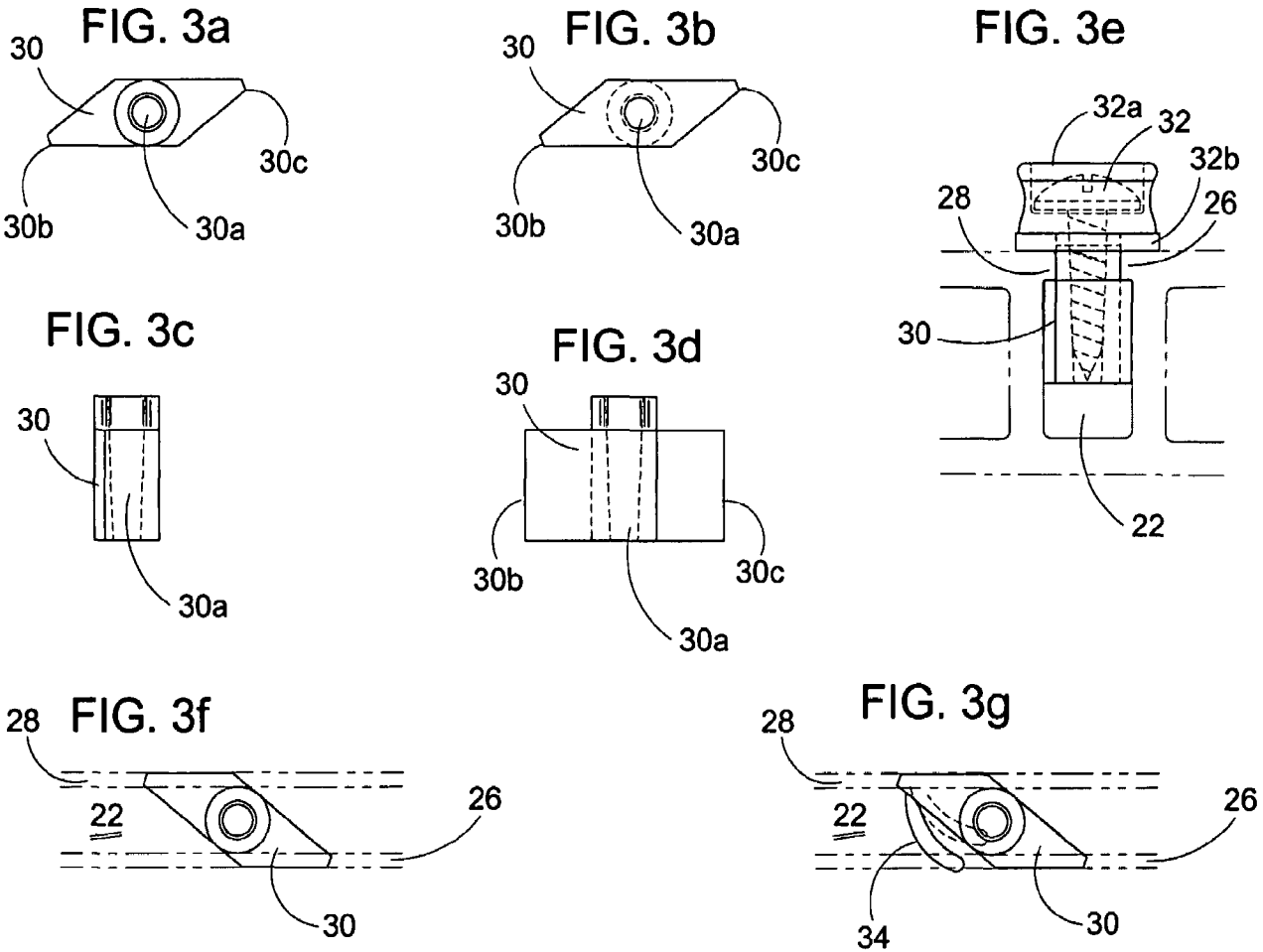
FIG. 3*a* is top view of the first embodiment of the invention showing the snap retainer anchor.
FIG. 3*b* is a bottom view of the first embodiment of the invention showing the snap retainer anchor.
FIG. 3*c* is an end view of the first embodiment of the invention showing the snap retainer anchor.
FIG. 3*d* is a side view of the first embodiment of the invention showing the snap retainer anchor.
FIG. 3*e* is an end view of the first embodiment of the invention showing the snap retainer anchor within the windshield frame slot, where the slot is shown in phantom lines.
FIG. 3*f* is a top view of the first embodiment of the invention showing the snap retainer anchor within the windshield frame slot, where the slot is shown in phantom lines.
FIG. 3*g* is a top view of the first embodiment of the invention showing the snap retainer anchor with an alternate spring like projection and shown within the windshield frame slot, where the slot is shown in phantom lines.

In the first embodiment of the present invention as best shown in top view FIG. 3*a*, bottom view FIG. 3*b*, end view FIG. 3*c* and side view FIG. 3*d*, anchors 30 have a central hole 30*a*, where a screw 32 holding a round male cover snap retainer 32*a* as seen in sectional end view FIG. 3*e*, with a plastic flat washer 32*b* thereunder, are threaded therein hole 30*a*. Anchors 30 include extending tabs 30*b* and 30*c*, where when anchors 30 are inserted into slots 22 or 24, anchors 30 are rotated so tabs 30*b* and 30*c* extend under slot lips 26 and 28 as seen in end view FIGS. 3*e* and 3*f*. When screw 32 is tightened, screw 32 clamps the tops of the tabs 30*b* and 30*c* to the inner edge of the slot lips 26 and 28 and washer 32*b* is in turn clamped to the outer edges of slots 26 or 28, thus fixing anchor 30 and the snap retainer 32*a* in a outward and forward orientation along windshield frame 12.

Anchor 30 may include one or more spring like projection 34, where the projection 34 springs out when inserted into the slot 22 or 24 to insure anchor 30 is rotated into contact with the inner sides of the slot 22 or 24 as seen in end view FIG. 3*g*. This insures that tabs 30*b* and 30*c* come under and contact under the slot lips 26 and 28 when screw 32 is tightened.

Figure 4B:
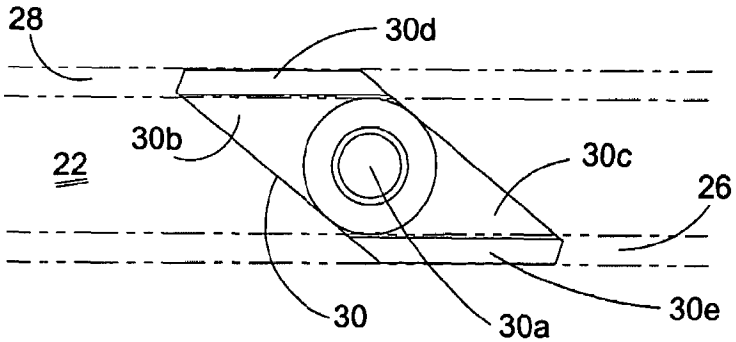
FIG. 4*b* is a close up top view of the first embodiment of the invention showing the snap retainer anchor with alternate spline and shown within the windshield frame slot, where the slot is shown in phantom lines.
Figure 4C:
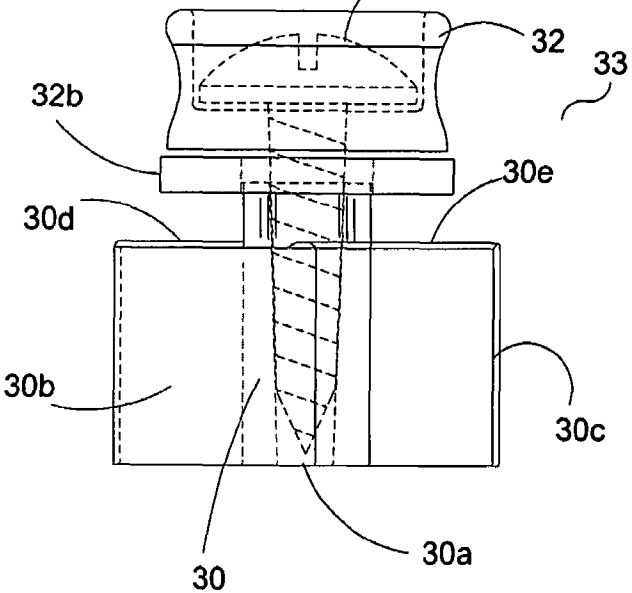
FIG. 4*c* is a close up side view of the first embodiment of the invention showing the snap retainer anchor as a single insertable unit.
Figure 4A:
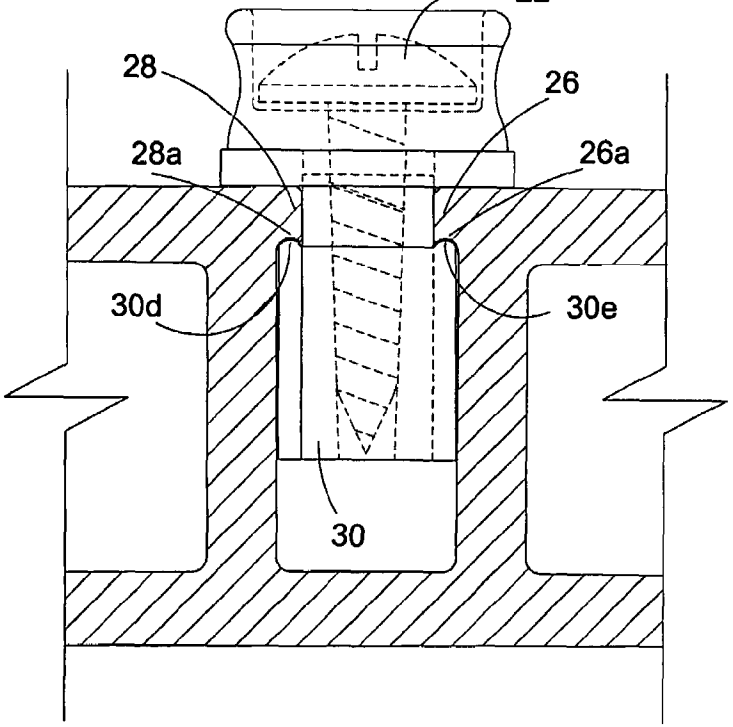
FIG. 4*a* is a partial sectional close up end view of the first embodiment of the invention showing the snap retainer anchor with an alternate spline mounted within the windshield frame slot.

As best seen in FIG. 4*a* a close up end view of the first embodiment of the present invention, shows the snap retainer anchor 30 with alternate splines 30*d* and 30*e*, on upper contact surface of tabs 30*b* and 30*c*. Where splines 30*d* and 30*e* fit into grooves 26*a* and 28*a* under slot lips 26 and 28, so as to prevent counter rotation and ejection of anchor 30 under extreme tension.

FIG. 4*c* is a close up side view of the first embodiment of the invention showing the snap retainer anchor 30, the screw 32, the male snap retainer 32*a* and the flat washer 32*b* as a single insertable unit 33. The single unit 33 makes stocking and sales easier, as well as for simpler installation.

Figure 5A:
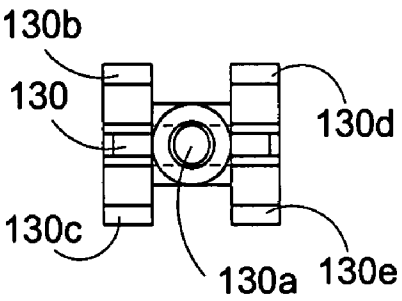
FIG. 5*a* is a top view of the second embodiment of the invention showing the snap retainer anchor.
Figure 5B:
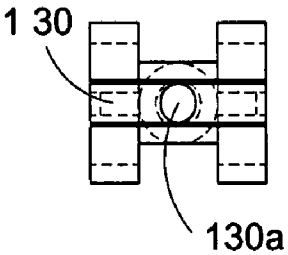
FIG. 5*b* is a bottom view of the second embodiment of the invention showing the snap retainer anchor.
Figure 5D:
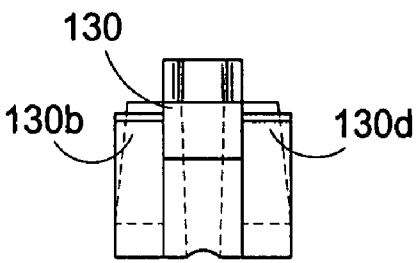
FIG. 5*d* is a side view of the second embodiment of the invention showing the snap retainer anchor.
Figure 5C:
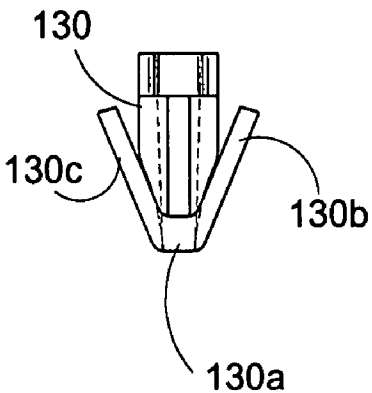
FIG. 5*c* is an end view of the second embodiment of the invention showing the snap retainer anchor.
Figure 5E:
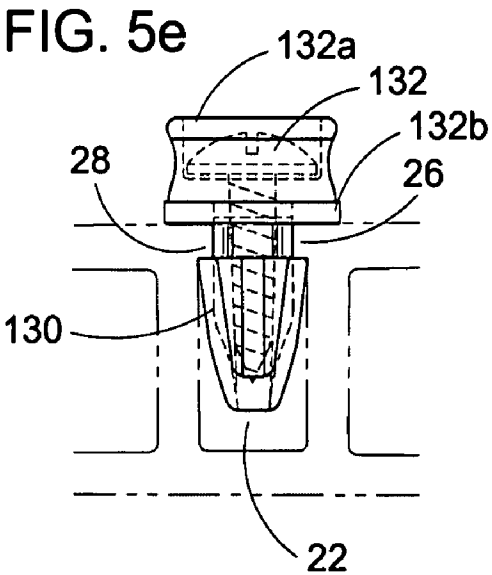
FIG. 5*e* is a partial end view of the second embodiment of the invention showing the snap retainer anchor within the windshield frame slot, where the slot is shown in phantom lines.
Figure 5F:
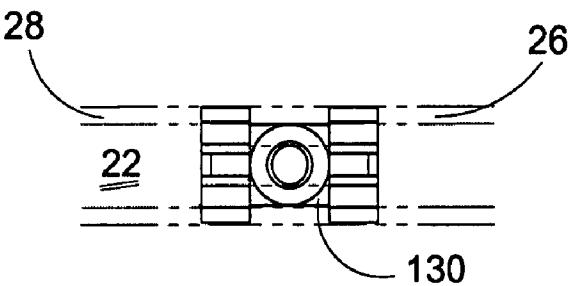
FIG. 5*f* is a top view of the second embodiment showing the snap retainer anchor within the windshield frame slot, where the slot is shown in phantom lines.

In a second embodiment of the present invention as best shown in top view FIG. 5*a*, bottom view FIG. 5*b*, end view FIG. 5*c* and side view FIG. 5*d*, the anchors 130 have a central hole 130*a*, where a screw 132 holding a male cover snap retainer 132*a*, with a plastic washer 132*b* thereunder, are threaded therein hole 130*a*. Anchors 130 include opposing vertical extending tabs 130*b*, 130*c*, 130*d* and 130*e*, where when anchor 130 is inserted into slots 22 or 24, tabs

130*b* and 130*c* spring out and extend under slot lips 26 and 28 as seen in end view FIGS. 4*e* and 4*f*. When screw 132 is tightened, screw 132 clamps the tops of the tabs 130*b*, 130*c*, 130*d* and 130*e* to the inner edge of the slot lips 26 and 28 and washer 132*b* is in turn clamped to the outer edges of slots 26 or 28, thus fixing anchor 130 and the snap retainer 132*a* in a outward and forward orientation along windshield frame 12.

Figure 6:
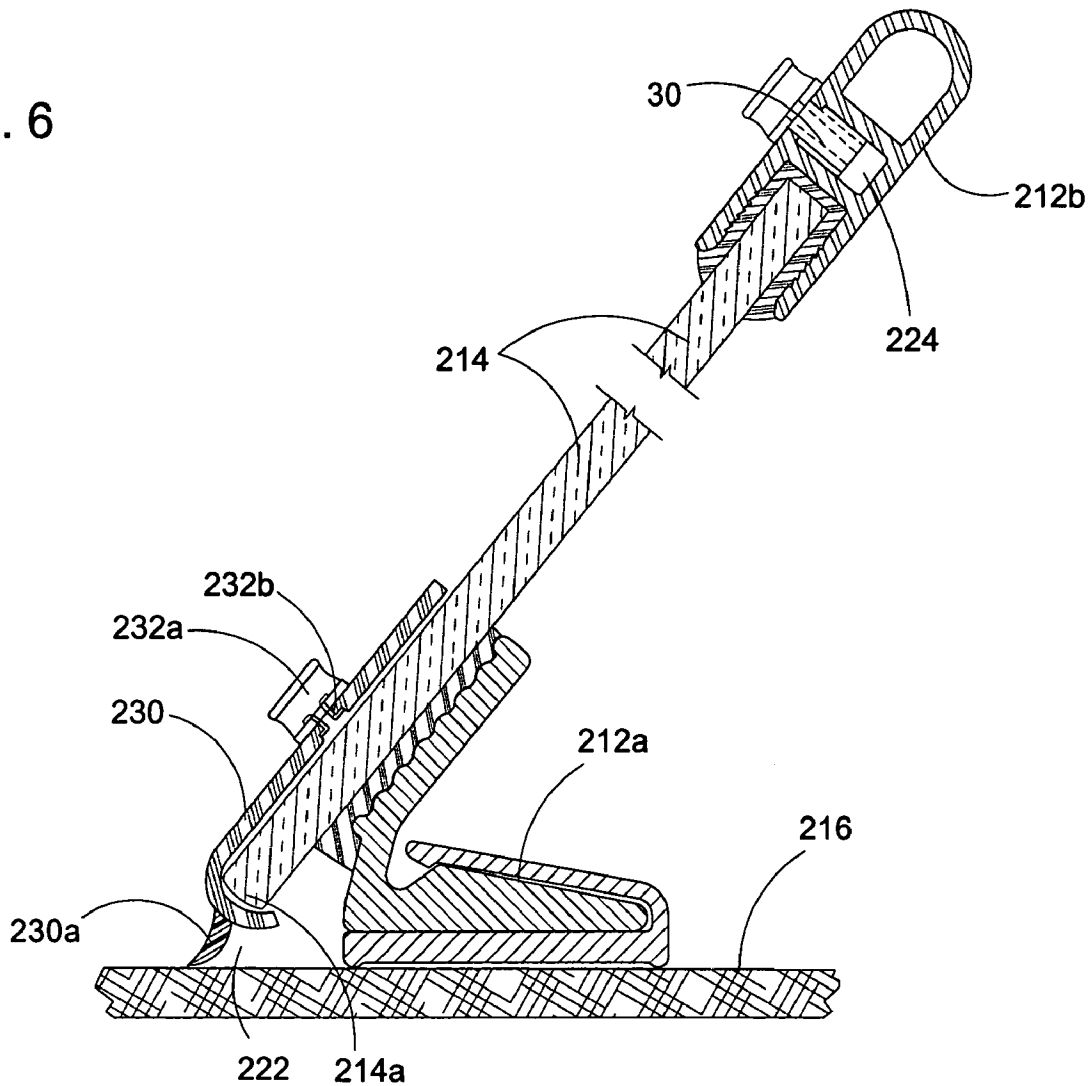
FIG. 6 is partial sectional view of the third embodiment of the invention taken along line C from FIG. 7, showing the hidden lower windshield frame mounted onto a boat deck.
Figure 7:
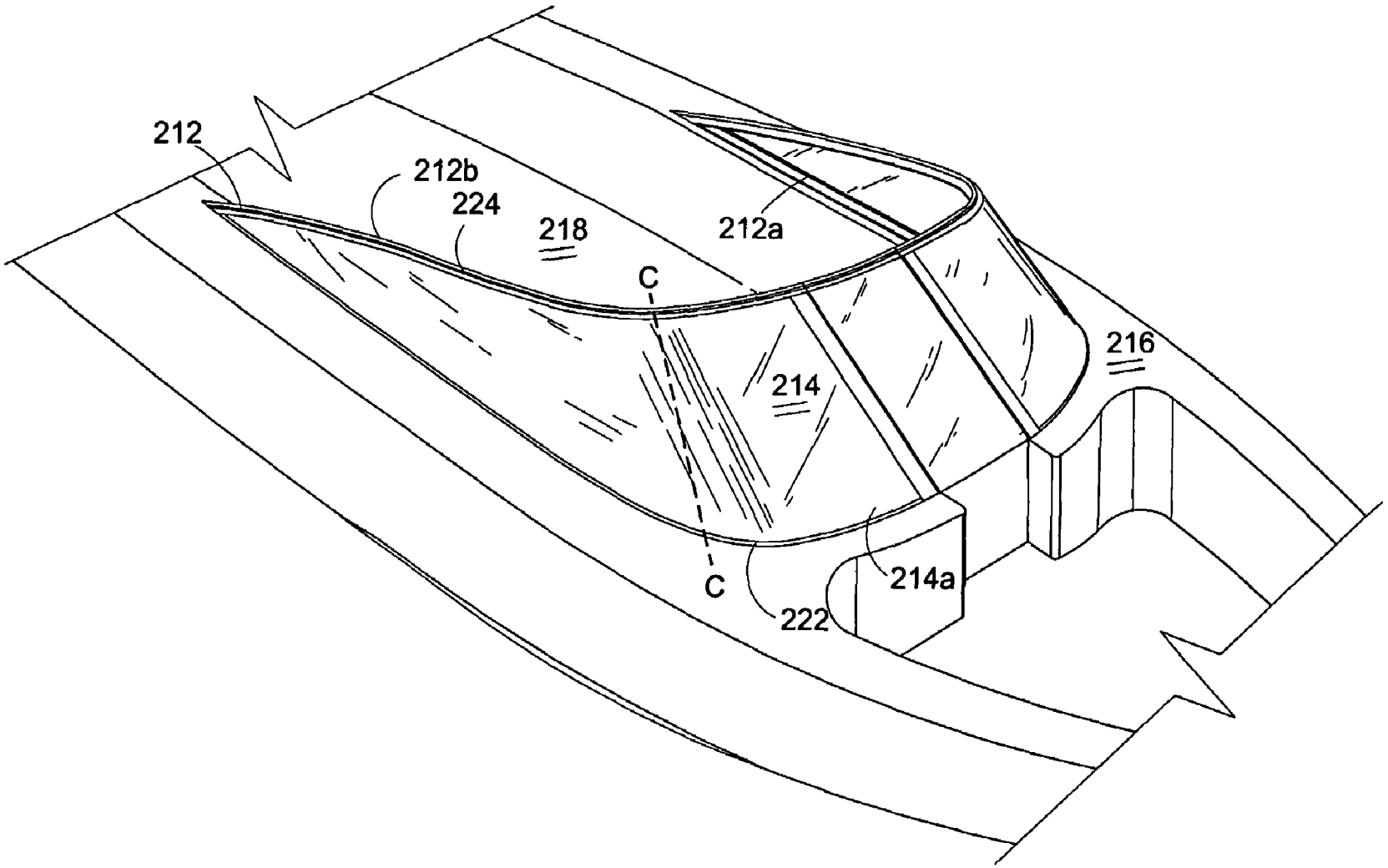
FIG. 7 is a partial perspective view of the third embodiment of the invention.

In a third embodiment of the present invention as best shown in partial sectional view FIG. 6, a hidden windshield bottom frame 212*a* is installed on boat deck 216, where the bottom windshield frame 212*a* is mountable to boat deck 216 rearward of the windshield 214. In this configuration, the forward and outward oriented slot 222 extends longitudinally along the bottom edge 214*a* of windshield 214. Slot 222 may best be seen in a partial perspective view in FIG. 7.

Slot 222 below the windshield accepts a series of plastic cover snap anchors 230, where anchors 230 are J-shaped to hook under the bottom of the windshield glass 214*a*. Anchor 230 is shown with a soft molded extension 230*a*. The round male snap retainer 232*a* attaches by rivet 232*b* on the anchor's 230 outward facing area, for attachment to the female snaps of a common boat cover (not shown). Alternately, anchors 230 could be sewn onto the edge of a boat cover. As well, the number of anchors 230 and the length of anchors 230 may vary depending on application.

Figure 8:
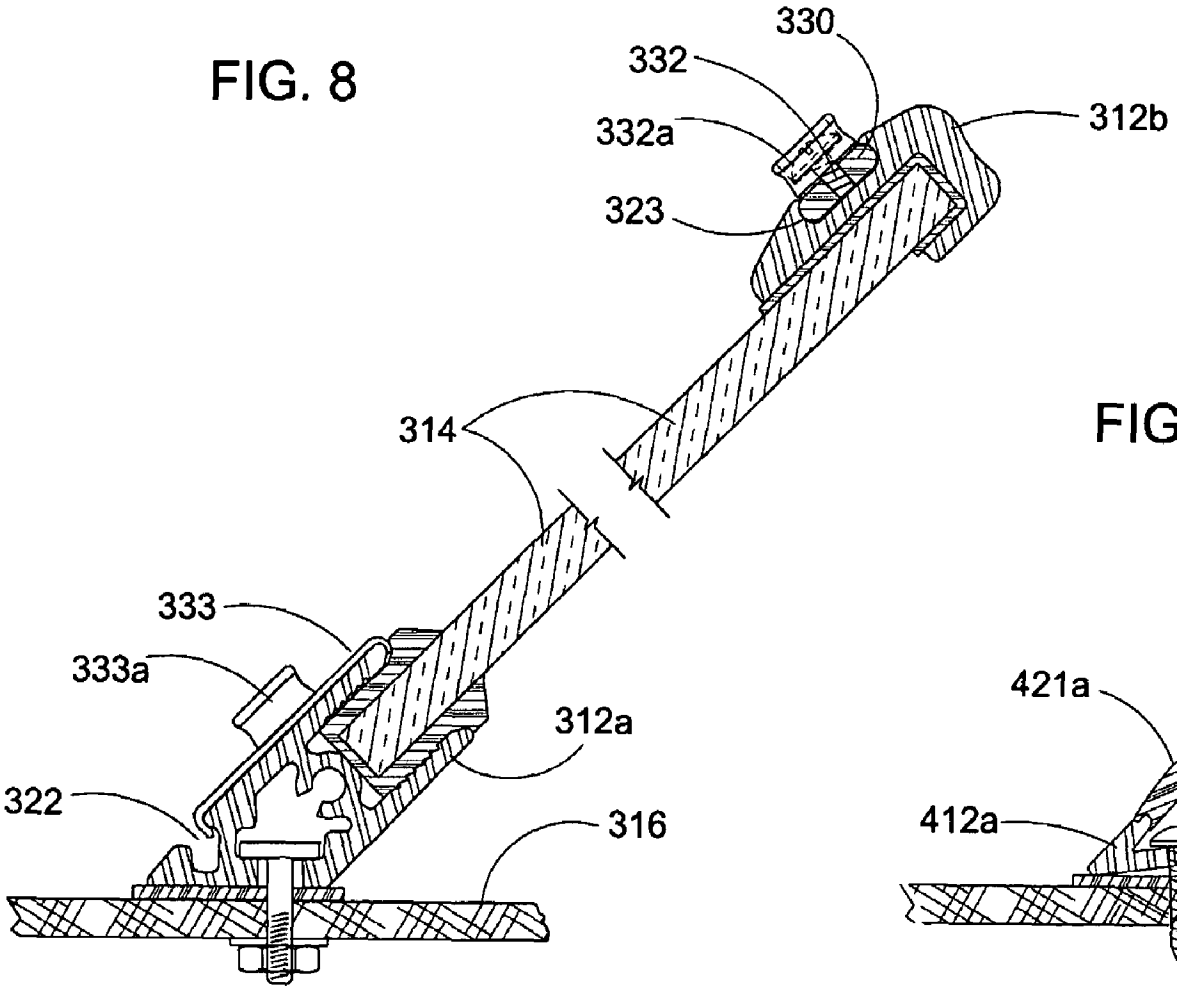
FIG. 8 PRIOR ART
FIG. 8 is a partial sectional view of a boat cover attachment system, marked as Prior Art.

As best seen in a partial sectional view in FIG. 8, a classic type of windshield and cockpit cover attachment system is marked as Prior Art, showing windshield 314 with bottom frame 312*a* with anchor slot 322 and top frame 312*b* with anchor slot 323. Attached on lower frame 312*a* is snap clip 333, where affixed to snap clip 333 is a male snap retainer 333*a*. Inserted in upper frame slot 323 is snap retainer anchor 330, where male snap retainer 332*a* is mounted onto snap retainer anchor 330 using screw 332.

Figure 9:
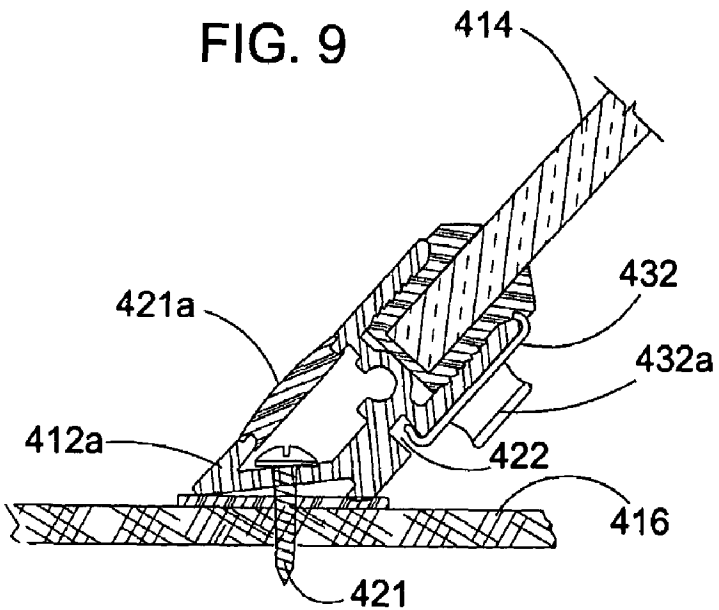
FIG. 9 PRIOR ART
FIG. 9 is a partial sectional view of a lower frame extrusion having a slot and snap attachments rearward of the windshield, marked as Prior Art.

As best seen in a partial sectional view in FIG. 9 a windshield 414 with a bottom frame extrusion 412*a* is attached to deck 416, by screw 421, which is covered by screw cover 421*a*, also marked as Prior Art, which is a design from Pacific Coast Marine Windshield Inc. The bottom frame 412*a* has a rearward facing slot 422, where a male snap retainer clip 432 attaches a male snap retainer 432*a*.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

It is intended that the scope of the invention be defined by the Claims appended hereto and their equivalents.

What is claimed is:

1. A marine windshield and boat cockpit cover attachment system comprising:

an elongated windshield frame longitudinally extending around the edge of said windshield, and where said windshield frame has at least a top length and a bottom length, where said bottom length is mountable to a boat deck;

said windshield frame having a forward and outward oriented slot longitudinally extending along said windshield frame, where said slot accepts a series plurality of rotatable cover snap anchors;

said slot includes inward facing lips on both opposing edges of said slot, where said rotatable cover snap anchors are inserted thereinbetween said slot inward facing lips;

said rotatable anchors having a central hole for accepting a threaded screw therein;

said screw fastens a male cover snap retainer;

said rotatable anchors includes a pair of apposing outward protruding extensions;

where said protruding extensions are rotated thereunder said slot inward facing lips, by friction of said screw threads against said anchor central hole, when tightening said screw where said male cover snap retainer is fastened onto outer edges of said lips, thereby securing said snap retainers in outward orientation along said windshield frame; where, said rotatable anchor is plastic and said screw is metal, where said screw metal makes no contact with said windshield frame; and wherein, said protruding extensions are rotated away from under said slot inward facing lips, by friction of said screw threads against said anchor central hole, when un-tightening said screw for removal of said rotatable anchor.

2. The cover attachment system of claim 1 wherein, said rotatable anchor has at least one resilient projection thereon at least one said protruding extension, where said resilient projection contacts onto at least one inner side of said slot.

3. The cover attachment system of claim 1 wherein, said rotatable anchor extensions have contacting splines on upper ends of said extensions, where said splines contact onto said underside of said lips on said slot.

4. The cover attachment system of claim 3 wherein, said underside of said lips on said slot have a groove, where said anchor extension splines on upper ends of said extensions make contact into said grooves of underside of said slot lips.

5. The cover attachment system as defined in claim 1 wherein, said rotatable anchors are adapted for mounting to a straight or curved windshield frame.

6. The cover attachment system of claim 1 wherein, said windshield frame bottom length has a dual segmented chamfered lower surface to improve mounting rigidity to said boat deck.

7. A marine windshield and boat cockpit cover attachment system comprising:

an elongated windshield frame longitudinally extending around the edge of said windshield, and where said windshield frame has at least a top length and a bottom length, where said bottom length is mountable to a boat deck;

said windshield frame having a forward and outward oriented slot longitudinally extending along said windshield frame, where said slot accepts a plurality of cover snap anchors;

said slot includes inward facing lips on both opposing edges of said slot;

said cover snap anchors have a central hole for accepting a threaded screw therein, and where said screw fastens a male cover snap retainer;

where each of said anchors include four upper extending contacting elements, where said upper extending contacting elements are directed towards and pressured onto underside of said lips, by tightening of said screw onto outer side of said lips, thereby securing said snap retainers in outward orientation along said windshield frame; and wherein, said windshield frame bottom length has a dual segmented chamfered lower surface to improve mounting rigidity to said boat deck.

8. A marine windshield and boat cockpit cover attachment system comprising:

an elongated windshield frame longitudinally extending along the top and bottom edge of a windshield glass, and where said windshield frame has at least a top length and a bottom length, where said bottom length is mountable to a boat deck, wherein said bottom length is mounted to said boat deck inward of said windshield glass, bottom edge;

where said windshield glass bottom edge is raised slightly away from said boat deck, thereby having a outward oriented slot longitudinally extending along the bottom of said windshield glass, where said slot accepts at least one cover anchor; and where, said cover anchor has a protruding hook, wherein said protruding hook is directed underneath said windshield glass bottom edge.

9. The cover attachment system of claim 8 wherein, said cover anchor is a plurality and where said cover anchors have male cover snap retainers, thereby securing said snap retainers in outward orientation along said windshield glass, adjacent said windshield glass bottom edge.

10. The cover attachment system of claim 8 wherein, said anchor is made of plastic.

11. The cover attachment system of claim 8 wherein, said anchor has a protruding tab plurality that is resilient, where said protruding tab is directed to cause friction against said boat deck so as to press said anchor hook against said windshield glass bottom edge.

12. The cover attachment system of claim 11 wherein, said anchor and said anchor protruding tab comprise a unitary member of two molded materials.

13. The cover attachment system of claim 8 wherein, said anchor is plastic and where no metal makes contact with said windshield.

14. The cover attachment system of claim 8 wherein, said anchor is sewn onto a bottom edge of said boat cover.

15. The cover attachment system as defined in claim 8 wherein, said anchor is adapted for mounting to a straight or curved windshield.

* * * * *